US010027011B2

(12) United States Patent
Hirota et al.

(10) Patent No.: US 10,027,011 B2
(45) Date of Patent: Jul. 17, 2018

(54) WAVEGUIDE DEVICE

(71) Applicant: Mitsubishi Electric Corporation, Tokyo (JP)

(72) Inventors: Akimichi Hirota, Tokyo (JP); Yukihiro Tahara, Tokyo (JP); Takashi Maruyama, Tokyo (JP); Tomohiro Takahashi, Tokyo (JP); Kazuyoshi Yamashita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 11 days.

(21) Appl. No.: 15/322,767

(22) PCT Filed: Aug. 31, 2015

(86) PCT No.: PCT/JP2015/074569
§ 371 (c)(1),
(2) Date: Dec. 29, 2016

(87) PCT Pub. No.: WO2016/039191
PCT Pub. Date: Mar. 17, 2016

(65) Prior Publication Data

US 2017/0141448 A1 May 18, 2017

(30) Foreign Application Priority Data

Sep. 9, 2014 (JP) ..... 2014-182978

(51) Int. Cl.
*H01P 1/02* (2006.01)
*H01P 3/12* (2006.01)

(52) U.S. Cl.
CPC ..... *H01P 3/12* (2013.01); *H01P 1/02* (2013.01); *H01P 1/022* (2013.01)

(58) Field of Classification Search
CPC .. H01P 1/02; H01P 1/025; H01P 1/027; H01P 1/165; H01P 1/022
(Continued)

(56) References Cited

U.S. PATENT DOCUMENTS

2004/0246062 A1 12/2004 Asao et al.
2008/0238579 A1 10/2008 Okano
2013/0088307 A1 4/2013 Dousset et al.

FOREIGN PATENT DOCUMENTS

EP 1 930 982 A1 6/2008
EP 2 722 926 A2 4/2014
(Continued)

OTHER PUBLICATIONS

International Search Report issued in PCT/JP2015/074569; dated Nov. 17, 2015.
(Continued)

*Primary Examiner* — Stephen E Jones
(74) *Attorney, Agent, or Firm* — Studebaker & Brackett PC

(57) ABSTRACT

The waveguide device, in which first/second openings are formed at end parts of a waveguide path, comprises a waveguide path obtained by uniting first/second waveguides. The first waveguide is provided with a first recessed part which has an opening with a same shape as the first opening and has a bottom part formed in a first direction as seen from the opening. The second waveguide is provided with a second recessed part which has an opening with a same shape as the second opening and has a bottom part formed in a second direction as seen from the opening. The first/second waveguides are united in a manner such that, positions of the bottom parts of the first/second recessed parts are different from each other in a direction differing from the first/second directions, and the first/second
(Continued)

recessed parts connect with each other at the respective bottom parts.

7 Claims, 12 Drawing Sheets

(58) Field of Classification Search
USPC ..... 333/239, 248, 21 A, 21 R, 135, 137, 249
See application file for complete search history.

(56) References Cited

FOREIGN PATENT DOCUMENTS

| | | | |
|---|---|---|---|
| JP | S52-016679 | A | 4/1977 |
| JP | H09-246801 | A | 9/1997 |
| JP | 2003-332801 | A | 11/2003 |
| JP | 3884725 | B2 | 2/2007 |
| JP | 2013-207391 | A | 10/2013 |
| WO | 2005/099026 | A1 | 10/2005 |

OTHER PUBLICATIONS

The extended European search report issued by the European Patent Office dated Mar. 16, 2018, which corresponds to European Patent Application No. 15839709.1 - 1205 and is related to U.S. Appl. No. 15/322,767.

WAVEGUIDE DEVICE

TECHNICAL FIELD

The present invention relates to a member, a component, a device, or the like, which has a structure functioning as a waveguide (hereinafter referred to as "a waveguide device").

BACKGROUND ART

Conventional examples of the application field of waveguides include (1) a communication device and (2) a radar device.

If assuming that there is a plurality of the above-described communication devices and there is a limitation on the size of their installation locations, there may arise necessity of connecting between waveguides of a certain communication device and another one. Those waveguides have different propagation directions of electromagnetic waves (hereinafter referred to as "a tube axis direction") which are propagated in the respective waveguides, and also have different direction of polarized waves (hereinafter referred to as "a polarization direction").

As a conventional waveguide device for changing the tube axis direction, there has been generally known a device called a waveguide bend or a waveguide corner, which has a structure formed by bending the waveguide (e.g., Patent Literature 1 below).

Patent Literature 1 discloses a structure, in which two waveguides are connected at a desired angle. Each of the two waveguides has a waveguide whose propagation path (hereinafter referred to as "a waveguide path") of electromagnetic waves is formed in a rectangular cross-sectional shape (hereinafter referred to as "a rectangular waveguide"). In addition, each waveguide is formed to include a step-like step face at a bend part where the tube axis direction is changed.

Note that, in the following description, the term "waveguide path" is used for indicating not only the propagation path itself, but also a structure defining the propagation path, such as an internal wall, or the both cases.

With regard to the rectangular waveguides, when considering a TE10 mode as a propagation mode used in many cases, a wide plane of an internal wall defining the waveguide path is sometimes called an "H-plane". This is because the wide plane is parallel to a direction of a magnetic field (H). On the other hand, a narrow plane of the internal wall is sometimes called an "E-plane" because the narrow plane is parallel to a direction of an electrical field (E).

The waveguide bend as described in Patent Literature 1 is sometimes called an E-plane bend (or corner) or an H-plane bend (or corner) depending on a plane along which the tube axis direction is changed. The waveguide bend of the above-described Patent Literature 1 corresponds to the E-plane bend.

In the case of the waveguide bend described in Patent Literature 1, the respective tube axis directions in two straight tube-shaped waveguide parts provided on the both sides of the bend part correspond to the central axes of the respective waveguide parts. In addition, straight lines indicating the tube axis directions in the two waveguides parts are in a relationship of being positioned on the same flat plane, and of intersecting each other at one point. Furthermore, long side directions of the cross-sectional shapes (rectangle in the case of Patent Literature 1) of the waveguide paths of the respective waveguide parts are parallel to each other.

Meanwhile, there has been known a waveguide device which changes the polarization direction without changing the tube axis direction (e.g., Patent Literature 2).

The waveguide device described in Patent Literature 2 discloses a polarized wave converter having a slit with a specific cross-sectional shape, which is disposed between two rectangular waveguides (i.e., a vertically-polarized wave waveguide and a horizontally-polarized wave waveguide) whose polarization directions are orthogonal to each other.

Patent Literature 1: JP 9-246801 A

Patent Literature 2: JP 3884725 B1

SUMMARY OF INVENTION

As conceivable methods for constructing a waveguide device for connecting two waveguides whose tube axis directions and the polarization directions are both different, there may be a method of (1) combining the conventional H-plane bend and the E-plane bend, and a method of (2) combining the bend described in Patent Literature 1 and the waveguide device described in Patent Literature 2.

However, in the case (1) described above, two types of bends with different operations are used. It is therefore necessary to separate the parts of the respective bents where conversion is performed (e.g., parts corresponding to the bend part in Patent Literature 1) so that a space is provided therebetween. This may cause a problem that the entire size of the waveguide device becomes larger.

In the case (2) described above, the length in the tube axis direction of the polarized wave converter is required to be about ¼ wavelength. Similarly to the case (1), it may cause the problem that the entire size of the waveguide device becomes larger.

The present invention has been devised for solving the above-described issue. The object of the present invention is to obtain a waveguide device which is capable of suppressing the size of a structure for changing the tube axis direction and the polarization direction.

A waveguide device according to the present invention is a waveguide device in which a first opening and a second opening are formed at end parts of a waveguide path. The waveguide device includes a waveguide path obtained by uniting a first waveguide and a second waveguide, wherein the first waveguide is provided with a first recessed part which has an opening with a same shape as the first opening and also has a bottom part being formed in a first direction as seen from the opening of the first recessed part, the second waveguide is provided with a second recessed part which has an opening with a same shape as the second opening and also has a bottom part being formed in a second direction as seen from the opening of the second recessed part, and the first waveguide and the second waveguide are united in a manner such that, center positions of the first and second openings are different from each other in a direction being different from the first and second directions, spatial regions of the bottom parts of the first and second recessed part partly overlap with each other in the different direction, a length of a region where the spatial regions of the bottom parts of the first and second recessed part partly overlap is equal to or less than ½ of an in-tube wavelength of electromagnetic waves propagating in the waveguide path, and the first and second recessed parts connect with each other at the respective bottom parts.

According to the waveguide device of the present invention, there can be obtained a waveguide device which is capable of suppressing the size of a structure for changing the tube axis direction and the polarization direction.

DESCRIPTION OF EMBODIMENTS

Figure 1:
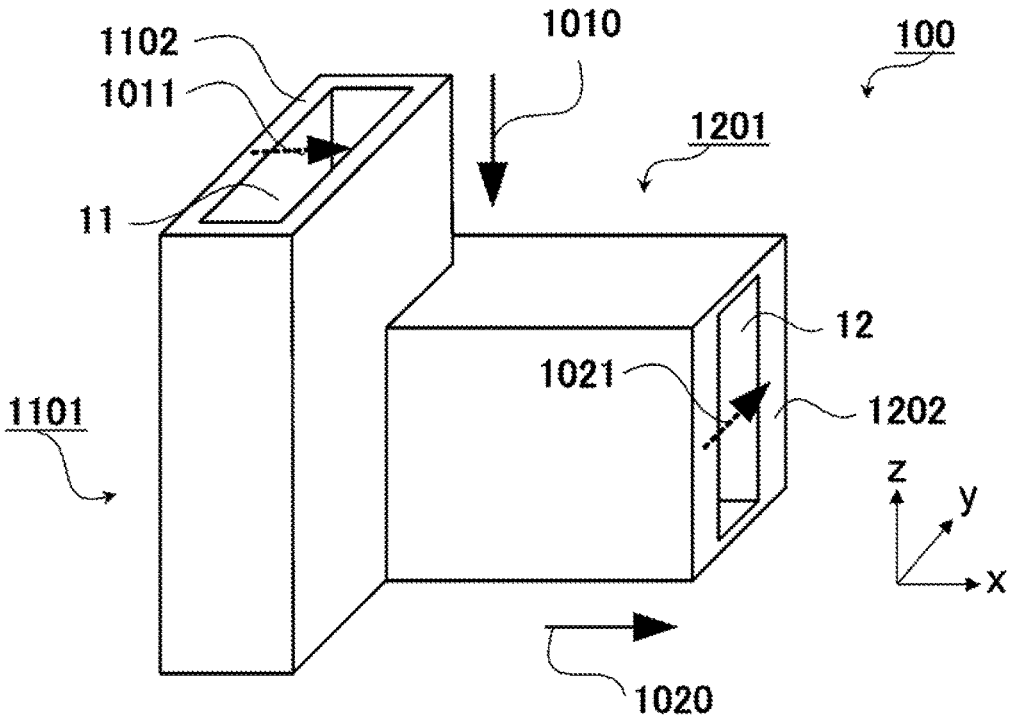
FIG. 1 is a diagram depicting a perspective view of an external appearance of a waveguide device according to Embodiment 1 of the present invention.

The embodiments of the present invention will be described below with referring to the drawings.

Note that, in the drawings for the following embodiments, the same or similar reference signs are assigned to the same or similar component. In addition, similar reference signs are assigned to corresponding components. In the description of the embodiments, the description and the detailed explanation of such components may be omitted in some cases.

Furthermore, when a plurality of parts of a certain constituent element are described in a distinguishable manner, alphabetical characters (a, b, and so on) are assigned to the reference signs. When the plurality of parts is described as one unit, the parts are sometimes described without the alphabetical characters.

The shapes depicted in the drawings indicate schematic diagrams simplified to an extent required for describing the invention. The detailed shapes of parts indicated in the drawings and parts of a waveguide device 100 that are not indicated in the drawings are not limited to those indicated in the drawings. For example, those may be (1) minute recesses and protrusions of wall planes, (2) a change in dimension, and (3) a change in shape may be made to such an extent that the performance as the waveguide device 100.

In addition, elements and parts in the drawings may indicate divided ones for the sake of expediency in explaining the present invention, and the ranges and the mounting forms thereof are not limited to the configurations, divisions, names, and the like that are indicated in the drawings. In addition, the way of the division is not limited to one indicated in the drawings.

(Embodiment 1)

Embodiment 1 of the present invention will be described below with referring to FIGS. 1 to 8.

For clearly explaining a waveguide device of the present embodiment without impairing generality, the description will be given of an example satisfying the following aspects: (1) a connection destination of the waveguide device is assumed to be a rectangular waveguide, and the waveguide device has a shape and a structure suitable for this assumption; (2) a TE10 mode is presupposed as a propagation mode of electromagnetic waves in order to explain change in the polarization direction, (3) the tube axis direction and the polarization direction are each changed orthogonally; and (4) wall planes are all formed in flat shape.

Note that the waveguide is not limited to the rectangular waveguide, and the waveguide is only required to have a waveguide path with a structure in which a long side direction and a short side direction of a cross-sectional shape of the waveguide path can be defined. However, it is desirable to have a symmetrical shape. For example, the waveguide device desirably has (a) a rounded-cornered square shape or (b) an elliptical shape.

FIG. 1 is a diagram depicting a perspective view of an external appearance of a waveguide device according to the Embodiment 1 of the present invention.

Figure 2:
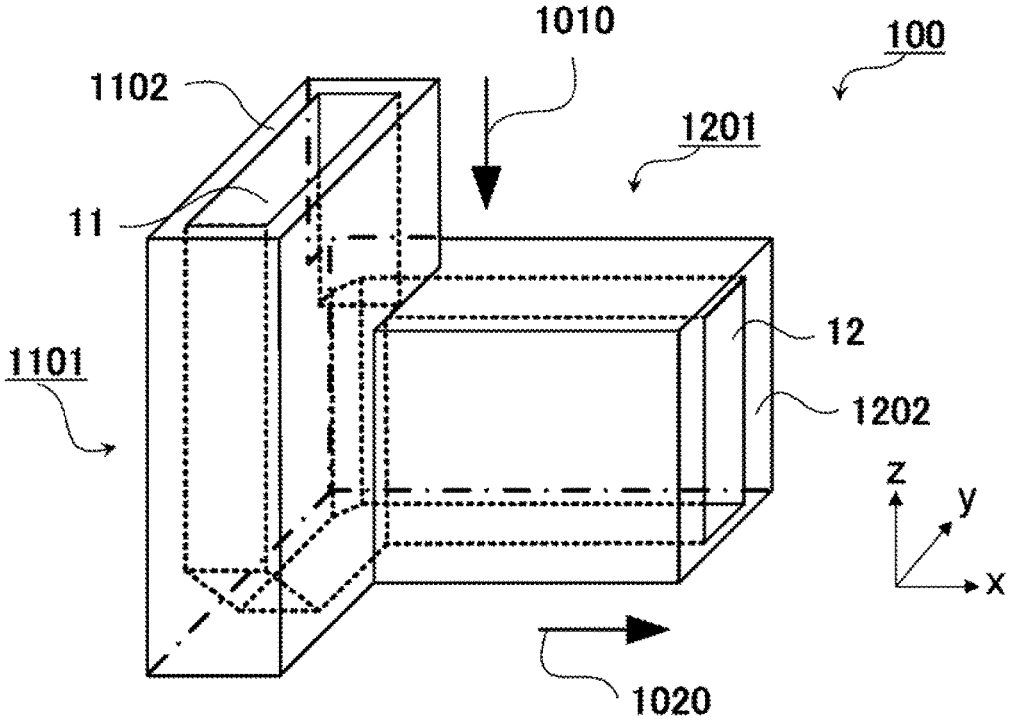
FIG. 2 is a diagram depicting a perspective view of a transparently-viewed structure of the waveguide device according to the Embodiment 1 of the present invention.

FIG. 2 is a diagram depicting a perspective view of a transparently-viewed structure of the waveguide device according to the Embodiment 1 of the present invention. In this FIG. 2, the shapes of hidden portions of internal walls and external walls are also depicted.

Figure 11:
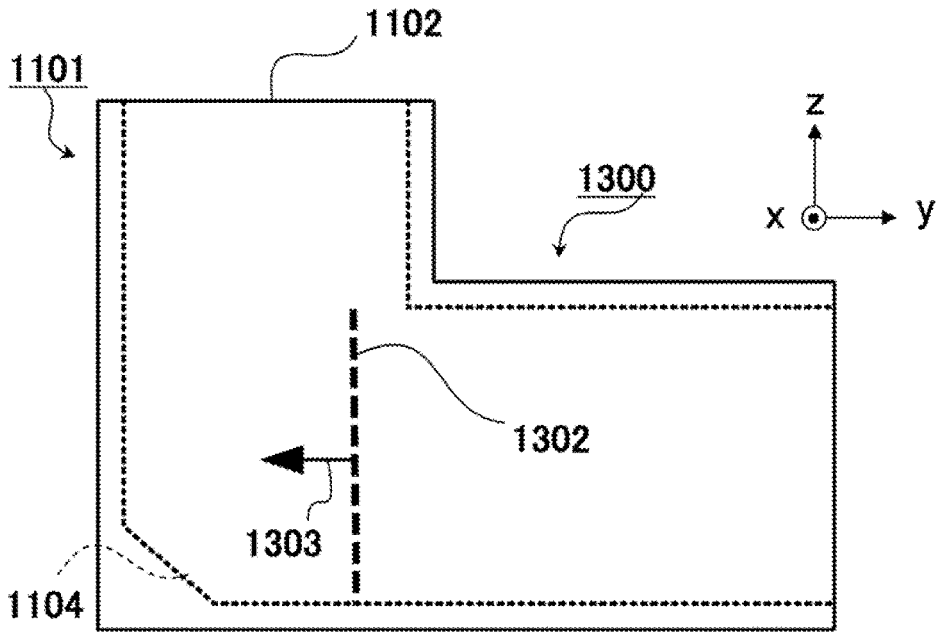
FIG. 11 is a diagram expediently depicting a side view of the analysis model for analyzing the region corresponding to the imaginary overlap of waveguides.

In FIGS. 1 and 2, 11 denotes a first opening, 12 denotes a second opening, 100 denotes a waveguide device, 1010 denotes a first tube axis direction, 1011 denotes a first polarization direction, 1020 denotes a second tube axis direction, 1021 denotes a second polarization direction, 1101 denotes a first waveguide part. 1102 denotes a first opening part, 1201 denotes a second waveguide part, 1202 denotes a second opening part, and x, y, and z denote expedient coordinate axes. Note that, for the sake of expedience in explanation, the first waveguide part 1101 and the second waveguide part 1201 indicate ranges obtained by dividing the waveguide device 100.

In FIG. 2, dotted lines indicate lines representing internal walls of the waveguide device 100, and dashed-dotted lines indicate lines representing external walls which are hidden at the rear sides and not shown in FIG. 1.

The arrows of the tube axis directions 1010 and 1020 are provided on an assumption that electromagnetic waves propagate from the first opening part 1102 to the second opening part 1202.

In addition, the tube axis directions 1010 and 1020 are not limited to the arrows shown in the drawings. In other words, the tube axis directions 1010 and 1020 may be different from ones in the drawings in dependence on the traveling direction of electromagnetic waves input to or output from the waveguide device 100. Therefore, the term "tube axis direction" is not used on an assumption that a direction defined by both direction and axis of the arrow. It is instead used by considering a direction defined only by the axis of the arrow.

In the description of the present embodiment, the TE10 mode is presupposed. Hence, the polarization direction is parallel to narrow planes of an internal wall in each opening part.

Note that, the arrow direction indicating the polarization direction is periodically inverted as time advances. Thus, the combination of arrows in the drawing can be considered to indicate an example in a specific operating condition.

The waveguide device 100 includes the first opening part 1102 and the second opening part 1202.

The first opening 11 with a rectangular shape is formed in the first opening part 1102.

The second opening 12 with a rectangular shape is formed in the second opening part 1202.

In the drawings, the first opening 11 is formed to have a shape with a long side direction corresponding to a y-axis and a short side direction corresponding to an x-axis. Further, the second opening 12 is formed to have a shape with a long side direction corresponding to a z-axis and a short side direction corresponding to the y-axis.

In addition, the positions of the centers of the first and second openings 11 and 12 are different in directions differing from the first and second tube axis directions 1010 and 1020.

In addition, each of the first opening part 1102 and the second opening part 1202 can be regarded as an input terminal or an output terminal of the waveguide device 100.

The first waveguide part 1101 has the first opening part 1102 at one end part in the first tube axis direction 1010 (an end part in a +z direction in the drawings). In addition, a waveguide path is formed from the first opening 11 toward the other end part in the first tube axis direction 1010 (an end part in a −z direction in the drawings).

In the present embodiment, the first waveguide part 1101 has a straight tube-shaped waveguide structure on the first opening part 1102 side. Thus, the first tube axis direction in the present embodiment is defined by the straight tube-shaped part.

The second waveguide part 1201 has the second opening part 1202 at one end part in the second tube axis direction 1020 (an end part in a +x direction in the drawings). In addition, a waveguide path is formed from the second opening 12 toward the other end part in the second tube axis direction 1020 (an end part in a −x direction in the drawings).

In the present embodiment, the second waveguide part 1201 has a straight tube-shaped waveguide structure on the second opening part 1202 side. Thus, the second tube axis direction in the present embodiment is defined by the straight tube-shaped part.

The internal walls of the waveguide device 100 are formed to connect the openings of the first opening part 1102 and the second opening part 1202 with each other.

These internal walls define the shapes of the openings 11 and 12, and also define a waveguide path which connects between the first opening part 1102 and the second opening part 1202.

Accordingly, the openings 11 and 12 of the first opening part 1102 and the second opening part 1202 are formed at different end parts of the waveguide path. The details of the structure of the internal walls defining the waveguide path will be described later with referring to FIG. 3.

In addition, the internal walls defining the waveguide path have electric conductivity. Note that, it is not limited to a case where only the internal walls have electric conductivity, that is, a case where the internal walls are made of plating of metal material, for example. The entire waveguide device 100 may be made of material having electric conductivity.

Figure 3:
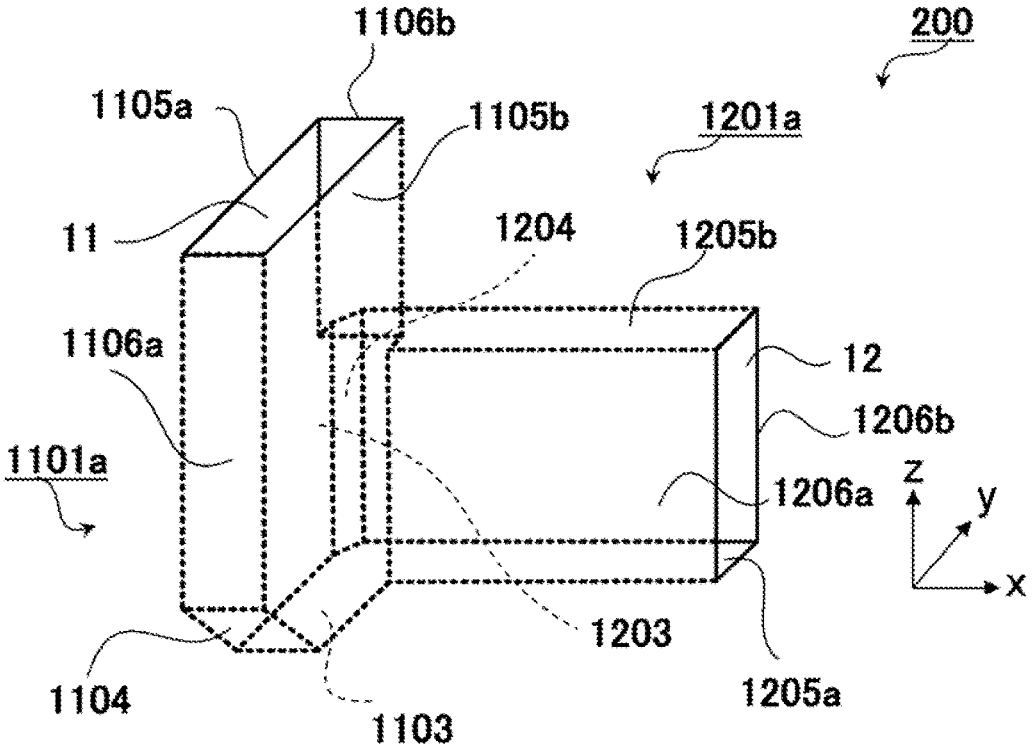
FIG. 3 is a diagram depicting a perspective view of the transparently-viewed structure of internal walls of the waveguide device according to the Embodiment 1 of the present invention.

FIG. 3 is a diagram depicting a perspective view of a transparently-viewed structure of internal walls of the waveguide device according to the Embodiment 1 of the present invention.

FIG. 3 represents a structure where the lines indicating the external walls (solid lines, dashed-dotted lines) are removed from FIG. 2.

The direction of view of this drawing is the same as that of FIG. 2.

In the drawing, 200 denotes internal walls (or a waveguide path defined by the internal walls), 1101*a* denotes an internal wall on the first waveguide part 1101 side (or a waveguide path defined by the internal wall), 1103 denotes a first end plane, 1104 denotes a first protruding face, 1105 (1105*a*, 1105*b*) denotes a pair of second planes, 1106 (1106*a*, 1106*b*) denotes a pair of first planes, 1201*a* denotes an internal wall on the second waveguide part 1201 side (or a waveguide path defined by the internal wall), 1203 denotes a second end plane, 1204 denotes a second protruding face,

1205 (1205*a*. 1205*b*) denotes a pair of third planes, and 1206 (1206*a*, 1206*b*) denotes a pair of fourth planes.

Figure 4:
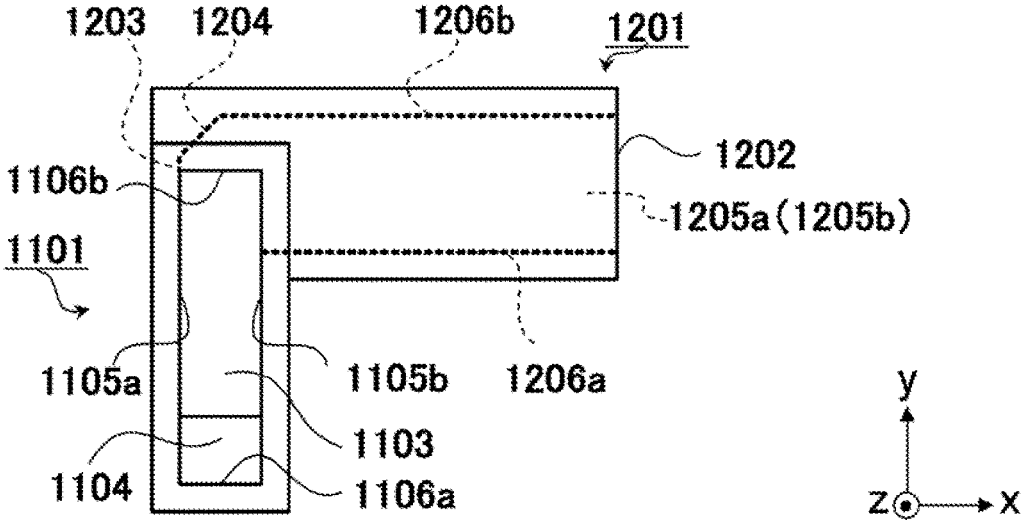
FIG. 4 is a diagram depicting a top view of the transparently-viewed structure of the waveguide device according to the Embodiment 1 of the present invention.
Figure 5:
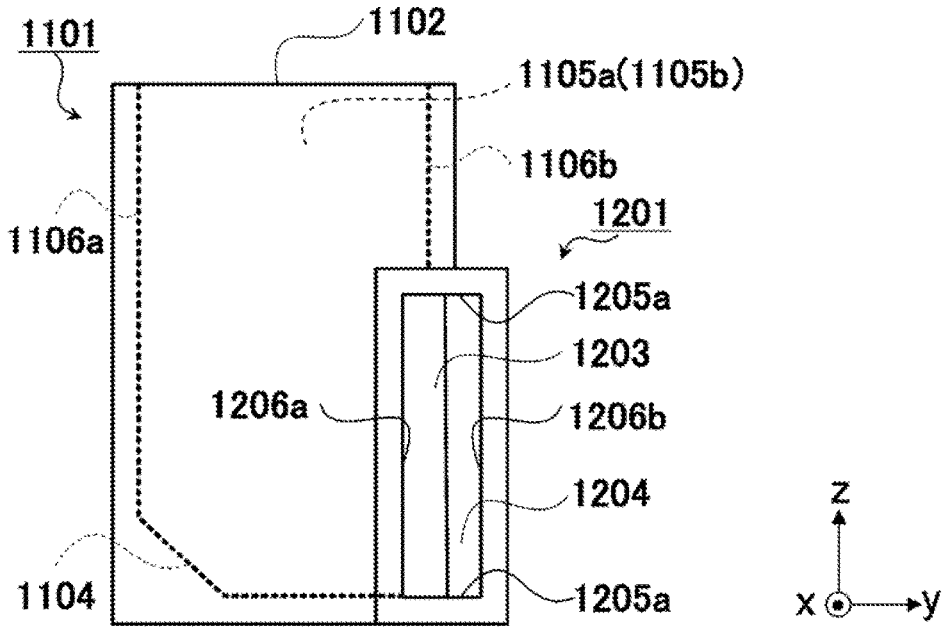
FIG. 5 is a diagram depicting a side view of the transparently-viewed structure of the waveguide device according to the Embodiment 1 of the present invention.

FIGS. 4 and 5 are a top view and a side view of a transparently-viewed structure of the waveguide device according to the Embodiment 1 of the present invention.

The elements shown in these drawings are equivalent to those in FIGS. 1 to 3 described above.

The internal walls 200 include the internal wall 1101*a* of the first waveguide part 1101 side and the internal wall 1201*a* of the second waveguide part 1201 side.

As indicated in the drawings, the first opening 11 and the second opening 12 are formed at the end parts of the waveguide path defined by the internal walls 200 (1101*a* and 1201*a*), respectively.

The internal wall 1101*a* of the first waveguide part 1101 side include flat planes 1103, 1104, 1105, and 1106.

The present embodiment corresponds to a case where each of the first planes pair 1105 and the second planes pair 1106 is a parallel flat plane pair which extends in parallel to the first tube axis direction 1010. In addition, the first end plane 1103 is a flat plane which is vertical to the first tube axis direction 1010.

In the first waveguide part 1101, the flat plane pair 1105 is separately formed in the long side direction of the shape of the first opening 11. The flat plane pair 1106 is separately formed in the short side direction of the shape of the first opening 11.

The internal wall 1201*a* of the second waveguide part 1201 side include flat planes 1203, 1204, 1205, and 1206.

The present embodiment corresponds to a case where each of the third planes pair 1205 and the fourth planes pair 1206 is a parallel flat plane pair extending in the second tube axis direction 1020. In addition, the second end plane 1203 is a flat plane vertical to the second tube axis direction 1020.

In the second waveguide part 1201, the flat plane pair 1205 is formed to separate along the long side direction of the shape of the second opening 12, and the flat plane pair 1206 is formed to separate along the short side direction of the shape of the second opening 12.

In the present embodiment, the long side directions of the shapes of the above-described two openings are not the same direction, and are in a relationship where the angle formed by those long side directions is orthogonal.

Note that, the shapes and dimensions (or dimension ratios) of the internal walls of the first waveguide part 1101 side and the second waveguide part 1201 side are not needed to be the same as each other. The dimensions (or dimension ratios) may be different depending on, for example, (1) the shape of the connection destination of the waveguide device 100, (2) the characteristics of demand to the waveguide device 100, or (3) a specific structure of the waveguide device.

Nevertheless, the internal walls are assumed to have such shapes and dimensions (or dimension ratios) that potential electromagnetic waves are able to propagate from the first waveguide part 1101 to the second waveguide part 1201.

In the present embodiment, the first end plane 1103 of the first waveguide part 1101 and the flat plane 1205*a* of the second waveguide part 1201 are formed to be positioned on the same single plane being parallel to an x-y flat plane. In addition, the flat plane 1105*a* of the first waveguide part 1101 and the second end plane 1203 of the second waveguide part 1201 are formed to be positioned on a single plane being parallel to a y-z flat plane.

The first protruding face 1104 and the second protruding face 1204 are formed on the respective end plane sides.

Here, for further clarifying the structure of the internal walls 200 of the waveguide device 100, that is, the structure of the waveguide path of the waveguide device 100, two waveguides are supposed.

In addition, the waveguide path of the waveguide device 100 is considered to be a waveguide path obtained by uniting two waveguides.

Figure 6:
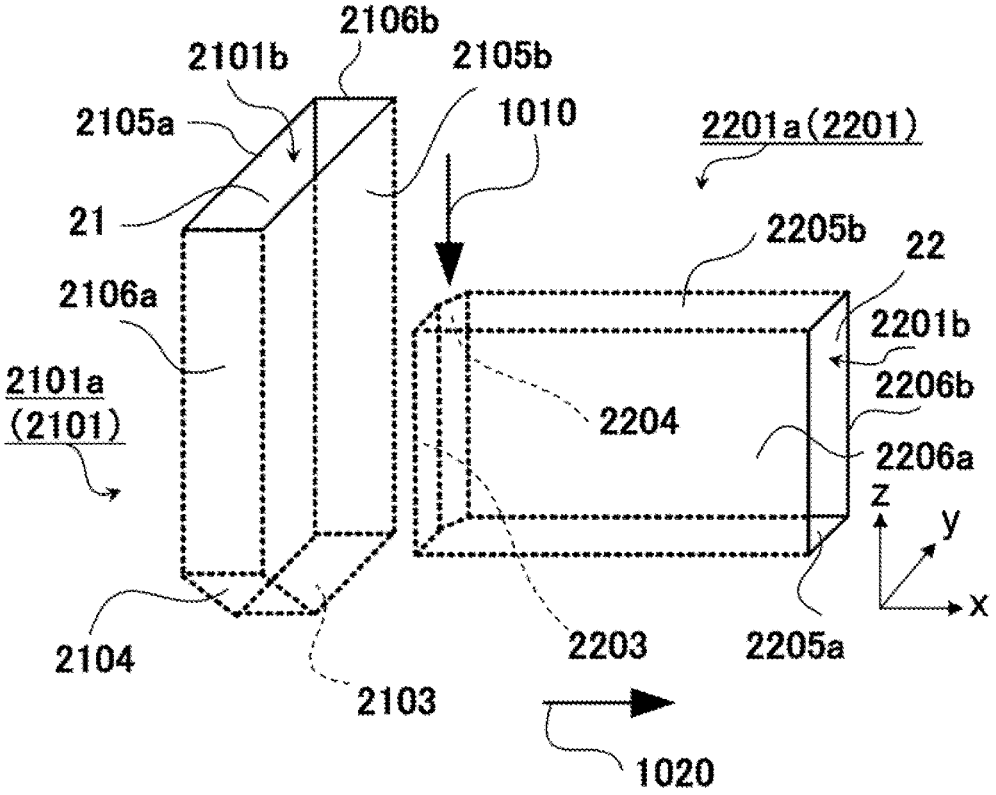
FIG. 6 is a diagram expediently depicting a perspective view of the transparently-viewed structures of individual two waveguides.

FIG. 6 is a diagram expediently depicting a perspective view of transparently-viewed structures of two waveguides.

Note that, in FIG. 6, for easily comparing with FIG. 3 indicating the waveguide device 100 of the present embodiment, the lines indicating the external walls indicated in FIG. 2 are not shown, and only the internal walls are shown. The description of the opening parts is omitted.

In addition, the view of the drawing, and the shape and the arrangement relationship of the components are the same as or correspond to those of FIG. 3.

In the drawing, 21 denotes a third opening. 22 denotes a fourth opening. 1010 denotes a first direction, 1020 denotes a second direction, 2101 denotes a first waveguide, 2101*a* denotes internal wall of the first waveguide, 2101*b* denotes a first recessed part, 2103 denotes a first end plane, 2104 denotes a first protruding face, 2105 (2105*a*, 2105*b*) denotes a pair of second planes, 2106 (2106*a*. 2106*b*) denotes a pair of first planes, 2201 denotes a second waveguide, 2201*a* denotes internal wall of the second waveguide, 2201*b* denotes a second recessed part, 2203 denotes a second end plane, 2204 denotes a second protruding face, 2205 (2205*a*, 2205*b*) denotes a pair of third planes, and 2206 (2206*a*, 2206*b*) denotes a pair of fourth planes.

The first direction 1010 is the same as the first tube axis direction shown in FIG. 1 representing the waveguide device 100 of the present embodiment. The second direction 1020 is the same as the second tube axis direction 1020 shown in FIG. 1.

The third opening 21 is formed in the first waveguide 2101.

The third opening 21 is formed to be the same shape as the first opening 11 in FIG. 1, and has a rectangular shape.

In the drawing, the long side direction and the short side direction of the third opening 21 correspond to the y-axis and the x-axis, respectively. The long side direction and the short side direction of the fourth opening 22 correspond to the z-axis and the y-axis, respectively.

In the first waveguide 2101, the first recessed part 2101*b* is formed from the third opening 21 toward an end part in the first direction 1010 (an end part in the −z direction in the drawing).

Thus, a bottom part of the first recessed part 2101*b* is disposed in the first direction 1010 as seen from the third opening 21.

The fourth opening 22 is formed in the second waveguide 2201.

The fourth opening 22 is formed to be the same shape as that of the second opening 12 shown in FIG. 1, and has a rectangular shape.

In the second waveguide part 1201, the second recessed part 2201*b* is formed from the fourth opening 22 toward an end part in the second direction 1020 (an end part in the −x direction in the drawing).

Thus, a bottom part of the second recessed part 2201*b* is disposed in the second direction 1020 as seen from the fourth opening 22.

The internal wall 2101*a* of the first waveguide 2101 includes flat planes 2103, 2104, 2105, and 2106.

A region surrounded by the internal wall 2101*a* corresponds to the first recessed part 2101*b*. A waveguide path of the first waveguide 2101 is defined by the internal wall 2101*a*.

Each of the flat plane pairs 2105 and 2106 of the first waveguide 2101 is a parallel flat plane pair extending in parallel to the first direction 1010. The first end plane 2103 is a flat plane vertical to the first direction 1010.

In the first waveguide 2101, the flat plane pair 2105 is formed to separate along the short side direction of the shape of the third opening 21, and the flat plane pair 2106 is formed to separate along the long side direction of the third opening 21.

The internal wall 2201*a* of the second waveguide 2201 includes flat planes 2203, 2204, 2205, and 2206.

A region surrounded by the internal wall 2201*a* corresponds to the second recessed part 2201*b*. A waveguide path of the second waveguide 2201 is defined by the internal wall 2201*a*.

Each of the flat plane pairs 2205 and 2206 of the second waveguide 2201 is a parallel flat plane pair extending in parallel to the second direction 1020. The second end plane 2203 is a flat plane which is vertical to the second direction 1020.

In the second waveguide 2201, the flat plane pair 2205 is formed to separate along the long side direction of the shape of the fourth opening 22, and the flat plane pair 2206 is formed to separate along the short side direction of the fourth opening 22.

Figure 7:
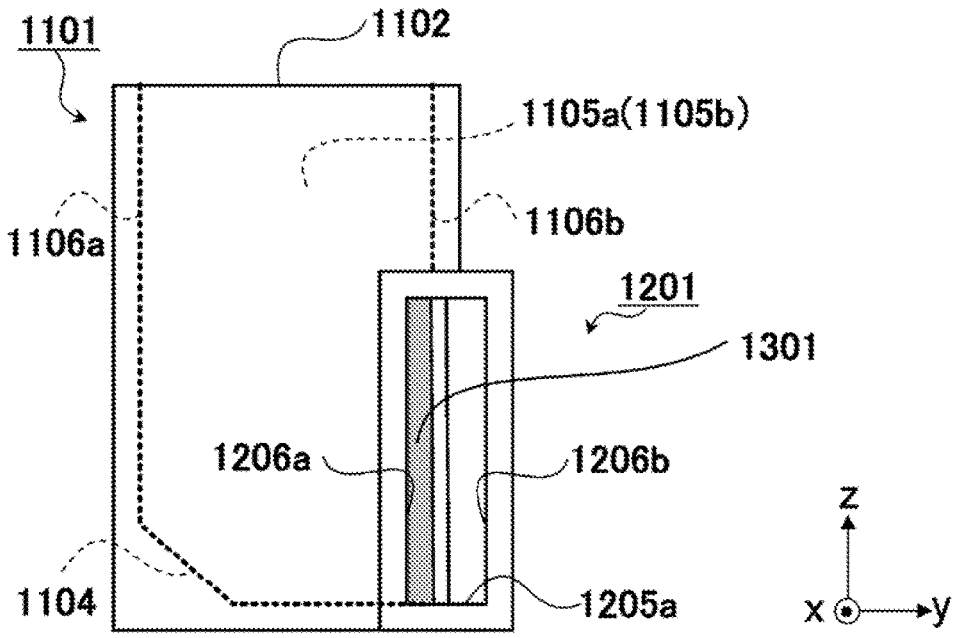
FIG. 7 is a diagram expediently depicting a side view of a region corresponding to an overlap of waveguides in a case where the waveguide device according to the Embodiment 1 of the present invention is transparently viewed.

FIG. 7 is a diagram expediently depicting a side view of a region corresponding to an overlap of waveguides in a case where the waveguide device according to the Embodiment 1 of the present invention is transparently viewed.

Figure 8:
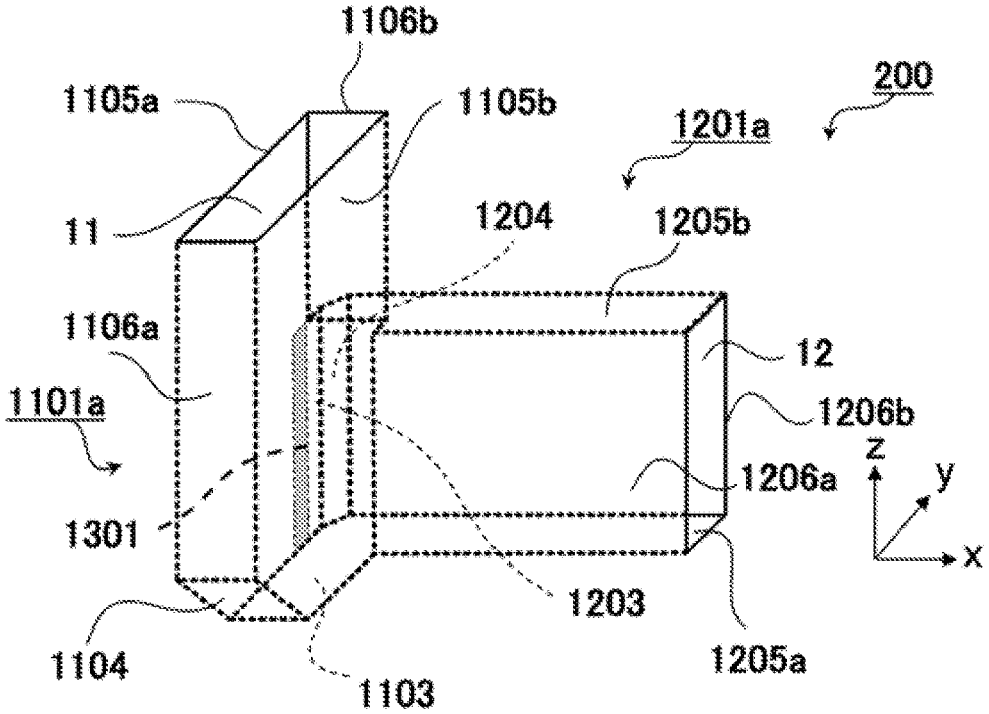
FIG. 8 is a diagram expediently depicting a perspective view of a region corresponding to an overlap of waveguides in a case where the internal walls of the waveguide device according to the Embodiment 1 of the present invention are transparently viewed.

FIG. 8 is a diagram expediently depicting a perspective view of a region corresponding to an overlap of waveguides in a case where internal walls of the waveguide device according to the Embodiment 1 of the present invention are transparently viewed.

The elements shown in these drawings are equivalent to the drawings described above.

In the drawings, 1301 denotes a range of the internal walls 200 of the waveguide device 100 indicated in FIG. 3 that corresponds to a range in which the flat plane 2105*a* and the second end plane 2203 overlap with each other when the first waveguide 2101 and the second waveguide 2201 indicated in FIG. 6 are united.

Here, it is assumed to compare between FIG. 6 indicating the two waveguides 2101 and 2201, and FIGS. 1 to 8 (excluding FIG. 6) indicating the waveguide device 100 of the present embodiment. It can be seen that the waveguide device 100 of the present embodiment includes a waveguide path corresponding to a waveguide path obtained by uniting the first waveguide 2101 provided with the first recessed part 2101*b* that is a recessed part in which an opening (the third opening 21 in FIG. 6) having the same shape as the first opening 11 is formed with a bottom part of the recessed part being disposed in the first direction 1010 as seen from the opening, and the second waveguide 2201 provided with the second recessed part 2201*b* that is a recessed part in which an opening (the fourth opening 22 in FIG. 6) having the same shape as the second opening 12 is formed with a bottom part of the recessed part being disposed in the second direction 1020 as seen from the opening, in such a manner that positions of bottom parts of the first and second recessed parts 2101*b* and 2201*b* are different from each other in a direction different from the first and second directions 1010 and 1020, and the first and second recessed parts 2101*b* and 2201*b* connect with each other in the bottom parts of the first and second recessed parts 2101*b* and 2201*b*. Accordingly, the above-described "uniting" can be interpreted as virtually uniting the two waveguides 2101 and 2201 while paying attention to the first and second recessed parts 2101*b* and 2201*b*.

In addition, it can be seen that the waveguide device 100 of the present embodiment includes a waveguide path corresponding to a waveguide path obtained by uniting the two waveguides 2101 and 2201 to partly overlap the bottom parts in such a manner that the recessed parts of the two waveguides 2101 and 2201 indicated in FIG. 6 connect with each other in the bottom parts.

In addition, it can be seen that the waveguide device 100 of the present embodiment includes a waveguide path corresponding to a waveguide path obtained by uniting the two waveguides 2101 and 2201 in such a manner that the position in the y-axis direction of the flat plane 2106*b* (a narrow plane) of the first waveguide 2101 indicated in FIG. 6 is located between the flat plane (a wide plane) pair 2206 of the second waveguide 2201.

In addition, it can be seen that the waveguide device 100 of the present embodiment includes a waveguide path corresponding to a waveguide path obtained by uniting the two waveguides in such a manner that the position in the x-axis direction of the flat plane (a wide plane) 2105*b* of the first waveguide 2101 indicated in FIG. 6 is located between the second end plane 2203 and the fourth 22 of the second waveguide 2201.

In addition, after uniting the two waveguides 2101 and 2201 indicated in FIG. 6, the positions of the individual centers of the third and fourth openings 21 and 22 are different in a direction (a y-axis direction in the drawing) which is different from the first and second directions 1010 and 1020.

As described above, after uniting the two waveguides 2101 and 2201 indicated in FIG. 6 in the above-described manner, there arises an overlap region of a region (the first recessed part 2101*b*) surrounded by the internal wall 2101*a* of the first waveguide and a region (second recessed part 2201*b*) surrounded by the internal wall 2201*a* of the second waveguide 2201. As a result, the waveguide paths of the two waveguides 2101 and 2201 connect with each other. Accordingly, a waveguide path corresponding to the internal walls 200 of the waveguide device 100 is formed as an internal structure of the waveguide device 100 of the present embodiment as indicated in FIGS. 2 and 3.

In the waveguide device 100 of the present embodiment having the above-described configuration, (1) the first waveguide part 1101, a region 1305 corresponding to an overlap of the recessed parts of the two waveguides indicated in FIG. 6, and a part on the first waveguide part side of the second waveguide part 1201 function as the H-plane bend, and in addition, (2) a part on the second waveguide part side of the first waveguide part 1101, the region 1305, and the second waveguide part 1201 function as the E-plane bend, and accordingly, (3) the waveguide device 100 can be considered to have an integrated function of the both bend functions. Therefore, both of the tube axis direction and the polarization direction can be changed by the single waveguide device 100.

Next, characteristics of the waveguide device 100 will be described with referring to FIGS. 9 to 17.

Figure 9:
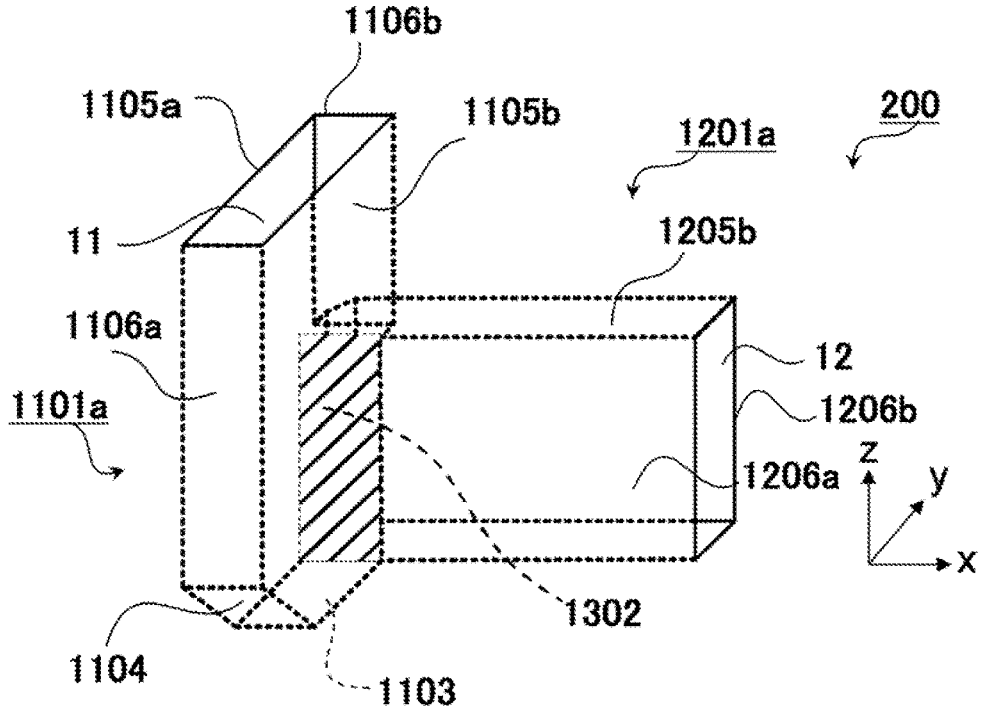
FIG. 9 is a diagram expediently depicting a perspective view of a region corresponding to an overlap of waveguides in a case where the internal walls of the waveguide device according to the Embodiment 1 of the present invention are transparently viewed.

FIG. 9 is a diagram expediently depicting a perspective view of a region corresponding to an overlap of waveguides in a case where internal walls of the waveguide device according to the Embodiment 1 of the present invention are transparently viewed. Similarly to FIG. 3, FIG. 9 is a diagram indicating the structure of the internal walls 200.

In the drawing, 1302 denotes an imaginary plane.

The imaginary plane 1302 is a plane obtained by extending the flat plane 1206*a* of the internal wall 1201*a* of the second waveguide part 1201 toward the flat plane 1105*a* (which is disposed in the −x direction in the drawing) of the internal wall 1101*a* of the first waveguide part 1101.

Further, the imaginary plane 1302 corresponds to a range where the first recessed part 2101*b* and the internal wall 2206*a* overlap with each other when the first waveguide 2101 and the second waveguide 2201 indicated in FIG. 6 are united.

Figure 10:
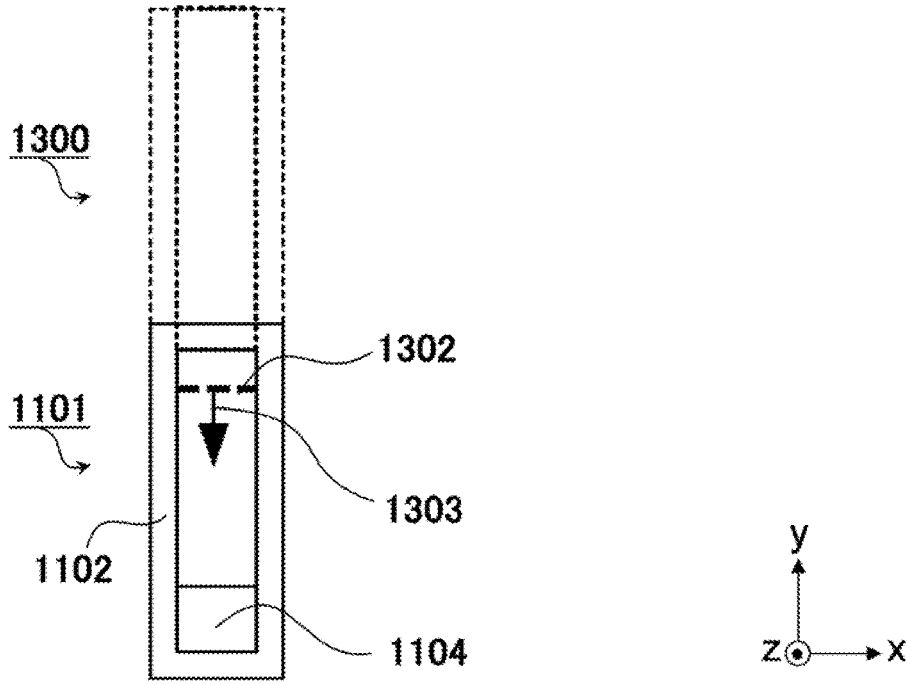
FIG. 10 is a diagram depicting a top view of an analysis model for analyzing a region corresponding to an imaginary overlap of waveguides.

FIGS. 10 and 11 are diagrams depicting a top view and a side view of an analysis model for analyzing a region corresponding to an imaginary overlap of waveguides.

In the drawings, 1300 denotes a straight-tube shaped waveguide obtained by modeling a region provided on the second waveguide part 1201 side from the imaginary plane 1302 in order to analyze a region from the imaginary plane 1302 to the first protruding face 1104. Further. 1303 denotes impedance looking from the imaginary plane 1302 into the first opening part 1102 side.

In FIGS. 10 and 11, a part of the waveguide path from the first opening part 1102 to the second protruding face 1204 is modeled.

Electromagnetic field analysis of the first waveguide part 1101 side is performed by using the models of FIGS. 9 and 10.

Here, it is assumed to make the impedance 1303 higher than a characteristic impedance of the waveguide path in the first opening part 1102 by adjusting at least either the dimension or the position of the first protruding face 1104 on a designing stage.

Figure 12:
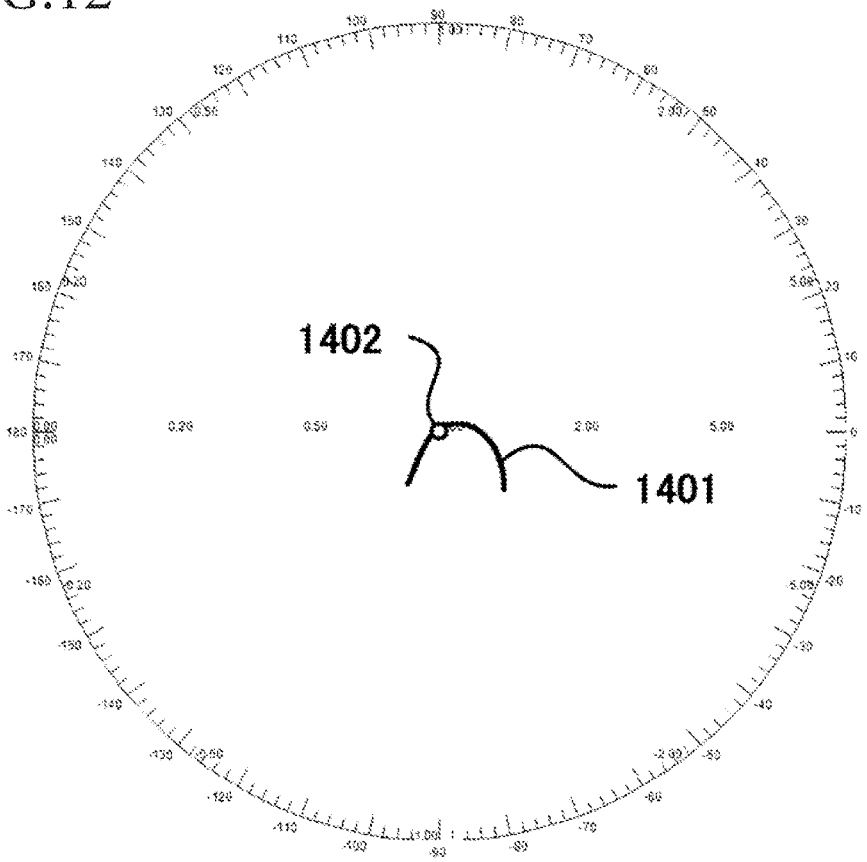
FIG. 12 is a chart diagram indicating frequency dependence of impedance of the waveguide device according to the Embodiment 1 of the present invention.

FIG. 12 is a chart diagram indicating frequency dependence of impedance looking from a region corresponding to an overlap of waveguides according to the Embodiment 1. In the drawing, the frequency dependence is represented by a so-called Smith chart.

In the drawing, 1401 denotes a locus of the impedance 1303 obtained by the above-described model, and 1402 denotes a center of the chart.

Note that, a frequency range in the analysis is set at 0.75 to 1.25 by normalizing the center frequency as 1.

In the drawing, in the locus 1401 of the impedance 1303, the left side of the chart center 1402 corresponds to a low frequency side and the right side corresponds to a high frequency side. According to this configuration, it can be seen from the drawing that, the impedance 1303 is higher on the high frequency side than that on the low frequency side.

Therefore, the impedance 1303 on the high frequency side can be made higher than the characteristic impedance of the waveguide path in the first opening part 1102 by adjusting at least either the dimension or the position of the first protruding face 1104.

Next, the electromagnetic field analysis of the characteristics seen from the second waveguide part 1201 side is performed.

Figure 13:
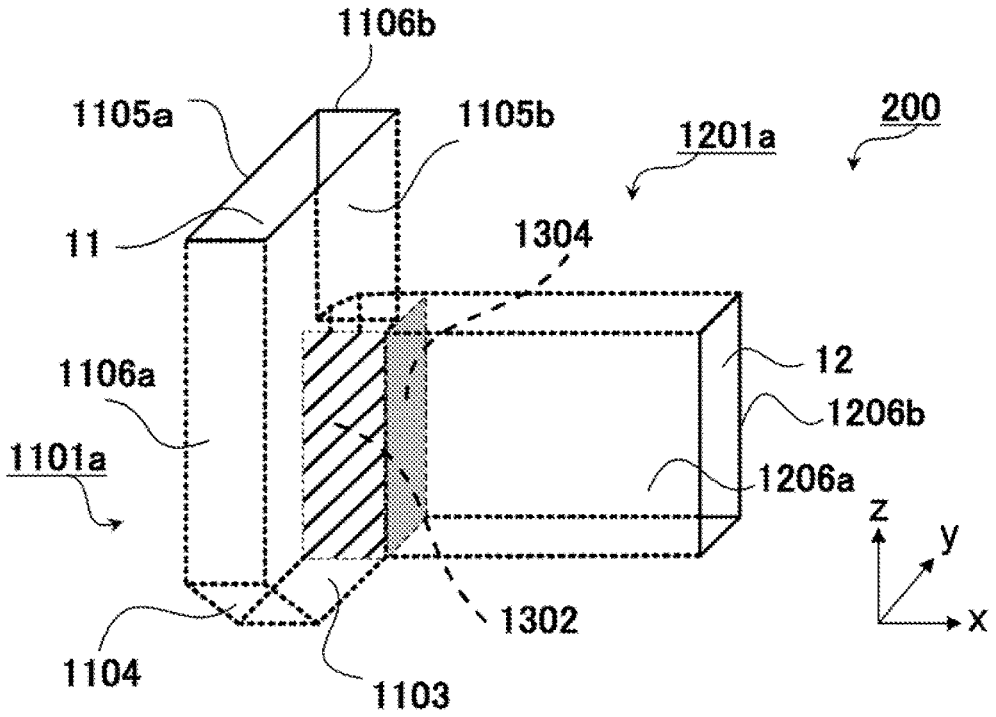
FIG. 13 is a diagram expediently depicting a perspective view of an analysis model for analyzing a region corresponding to the overlap of waveguides in a case where internal walls of the waveguide device according to the Embodiment 1 of the present invention are transparently viewed.

FIG. 13 is a diagram depicting a perspective view of an analysis model for analyzing a region corresponding to an overlap of waveguides in a case where internal walls of the waveguide device according to the Embodiment 1 of the present invention are transparently viewed.

Figure 14:
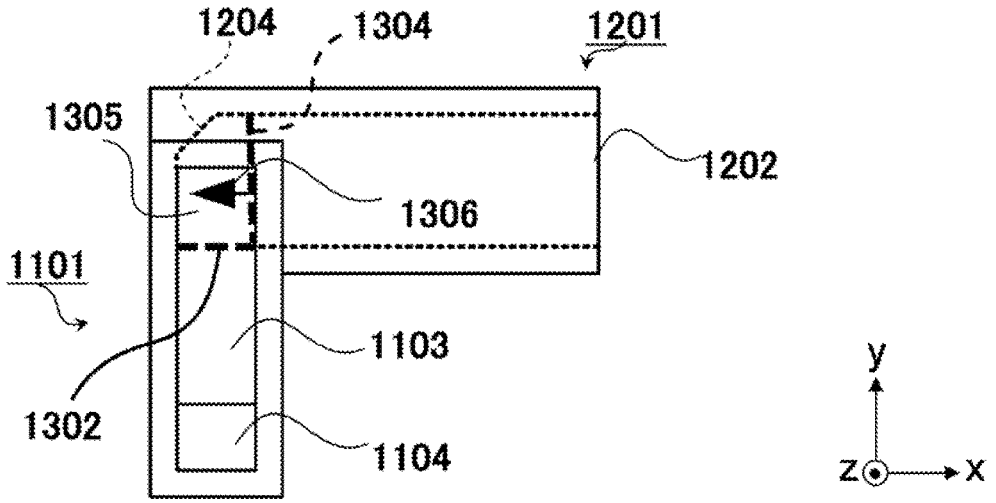
FIG. 14 is a diagram expediently depicting a top view of an analysis model for analyzing a region corresponding to the overlap of waveguides in a case where the waveguide device according to the Embodiment 1 of the present invention is transparently viewed.

FIG. 14 is a diagram depicting a top view of an analysis model for analyzing a region corresponding to an overlap of waveguides in a case where the waveguide device according to the Embodiment 1 of the present invention is transparently viewed.

The elements shown in these drawings are equivalent to those in the drawings described above.

In the drawing, 1302 denotes the imaginary plane shown in FIGS. 10 and 11, 1304 denotes an imaginary plane, 1305 denotes a region of a waveguide path that is located between the imaginary plane 1302 and the imaginary plane 1304, and 1306 denotes impedance looking from the imaginary plane 1304 into the first opening part 1102.

The imaginary plane 1304 indicates an overlap range between a plane obtained by extending the internal wall plane 1105*b* of the first waveguide part 1101 and a region surrounded by the internal wall 1201*a* of the second waveguide part 1201.

Here, it is assumed to making an equivalent characteristic impedance 1403 of the region 1305 between the imaginary planes 1302 and 1304 higher than a characteristic impedance of the second waveguide part 1201 by adjusting at least either the dimension or the position of the second protruding face 1204 on a designing stage.

In other words, it is assumed that the region 1305 between the imaginary planes 1302 and 1304 functions as an impedance converter.

Figure 15:
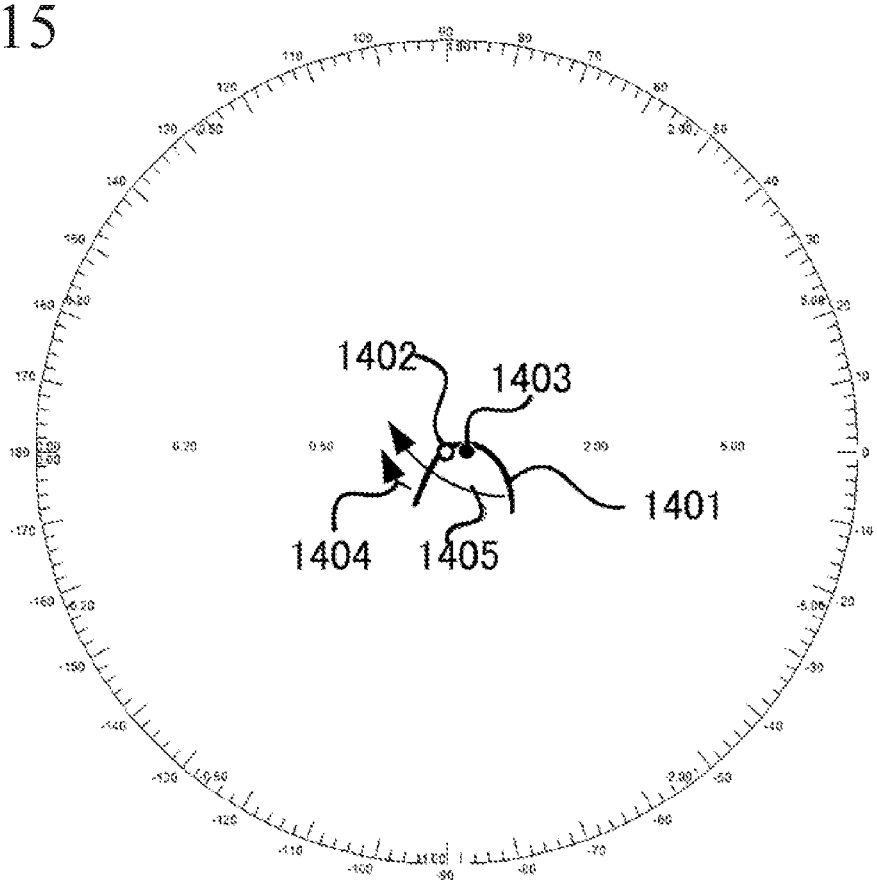
FIG. 15 is a chart diagram indicating frequency dependence of impedance of the waveguide device according to the Embodiment 1 of the present invention.

FIG. 15 is a chart diagram indicating frequency dependence of impedance of the waveguide device according to the Embodiment 1 of the present invention.

In the drawing, 1401 denotes a locus of the impedance 1303, 1402 denotes a center of the chart, 1403 denotes a center of the locus of the impedance 1303, and 1404 and 1405 are arrows indicating directions where the locus 1401 of the impedance changes. Except for the arrows 1404 and 1405, FIG. 15 is the same as FIG. 12 described above.

By utilizing the region 1305 to function as an impedance converter, the impedance 1306 looking from the imaginary plane 1304 into the first opening part 1102 may have the locus 1401 which indicates rotation of a clockwise direction around the impedance 1403, as represented by the arrows 1404 and 1405 in FIG. 15.

Since a wavelength on the high frequency side is shorter than a wavelength on the low frequency side, an equivalent electric length of the region 1305 becomes longer on the high frequency side. Thus, as indicated by the arrows 1404 and 1405, the locus on the high frequency side rotates more largely on the chart than the impedance locus on the low frequency side.

Figure 16:
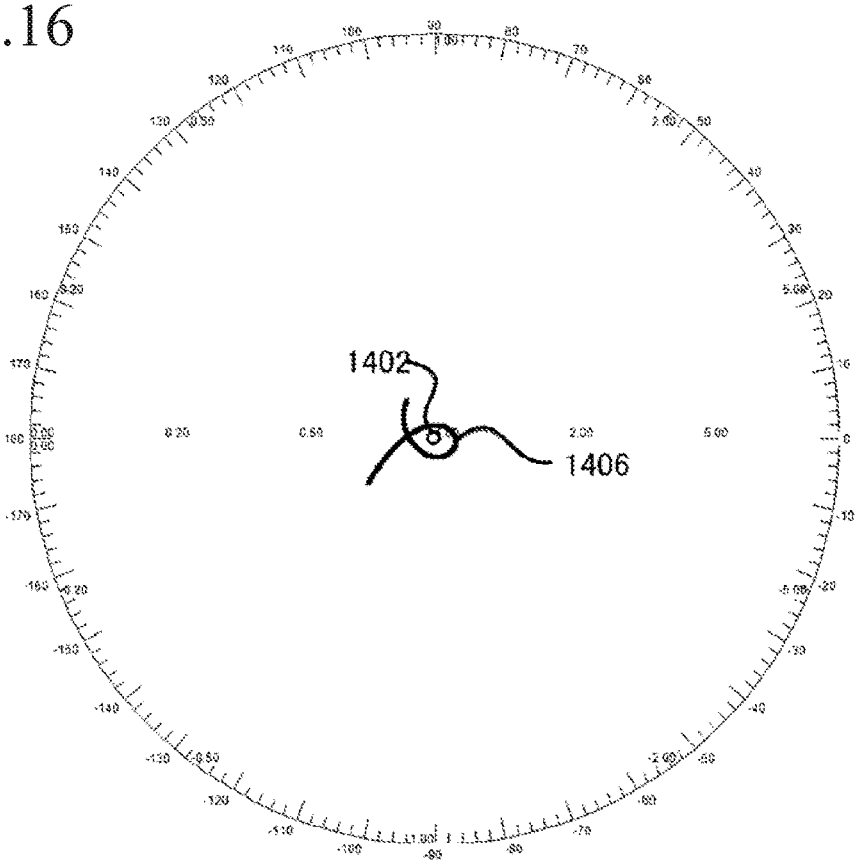
FIG. 16 is a chart diagram indicating frequency dependence of impedance of the waveguide device according to the Embodiment 1 of the present invention.

FIG. 16 is a chart diagram indicating frequency dependence of impedance of the waveguide device according to the Embodiment 1 of the present invention.

In the drawing, 1406 denotes frequency dependence of the impedance 1306 looking from the plane 1304 into the first opening part 1102 side.

It can be seen from FIG. 16 that, in the locus 1406 of the impedance 1306, a frequency range close to the center 1402 of the Smith chart increases in comparison with the locus 1401 of the impedance 1303.

Therefore, in the waveguide device 100 as a whole, the deterioration in reflecting characteristics with respect to electromagnetic waves can be suppressed in a wide fractional bandwidth.

Figure 17:
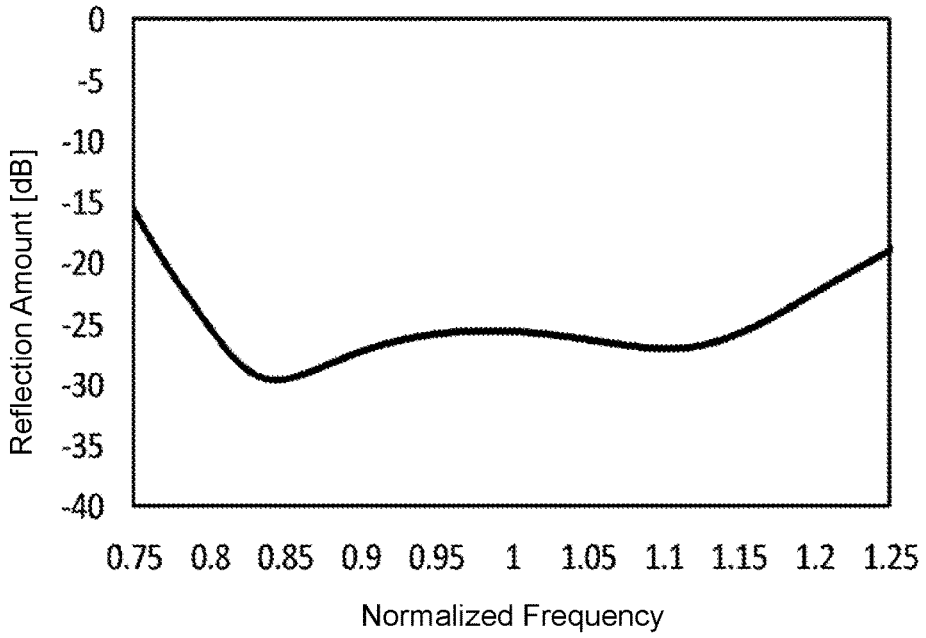
FIG. 17 is a diagram indicating frequency dependence of a reflecting characteristics of the waveguide device according to the Embodiment 1 of the present invention.

FIG. 17 is a diagram indicating frequency dependence of reflecting characteristics of the waveguide device according to the Embodiment 1 of the present invention.

The drawing indicates an analysis result of the reflecting characteristics in the first opening part 1102, which corresponds to the characteristics shown in FIG. 16.

In the drawing, for instance, fractional bandwidths whose reflection amounts are equal to or less than −20 dB account for 46%. It can be considered that the waveguide device 100 has better reflecting characteristics over the wide fractional bandwidth.

In addition, if an equivalent length of the waveguide path of the region 1305 becomes longer, the locus 1401 of the impedance shown in FIG. 15 may rotate largely in the direction of the arrows indicated in the drawing. As a result, since the locus 1406 of the impedance moves away from the center of the Smith chart, the reflecting characteristics may deteriorate.

Therefore, the size of a range of the region 1305 is desirably set to be equal to or less than ½ of an in-tube wavelength in the lowest frequency of operating frequencies of the waveguide device 100.

Note that, there is no need to set the value to be equal to or less than ½ of the in-tube wavelength in all waveguide devices to which the present invention has been applied. Alternatively, a different value may be set depending on Embodiment and a specific mounting form. For example, the value may be set to be equal to or less than ⅓.

If the size of the region 1305 is defined by the above-described standard, as indicated by the range 1301 indicated in FIGS. 7 and 8 described above, the wide plane 1105*a* of the first waveguide part 1101 and the end plane 1203 of the second waveguide part 1201 partly overlap with each other.

As described above, according to the waveguide device of the present embodiment, there can be obtained a waveguide device that can suppress the size of a structure for changing the tube axis direction and the polarization direction.

In addition, a waveguide device having better reflecting characteristics over the wide fractional bandwidth can be obtained.

In the present embodiment, the description has been given of a case where each of the first and second waveguide parts 1101 and 1201 has external wall planes forming a straight tube shape as a whole. However, it is sufficient that the structure of the waveguide path of the waveguide device 100 has the above-described structure according to the present invention, and the external walls are not limited to those in the embodiment. For example, the waveguide device 100 may have such external walls that the external form of the entire waveguide device 100 is (1) a cuboid shape or (2) a rounded-cornered cuboid shape.

In the present embodiment, the waveguide device 100 has the internal walls 200 of the waveguide path obtained by uniting the two waveguides 2101 and 2201 shown in FIG. 6 to satisfy that each of the following plane set (1) and (2) extends on the individual same plane: (1) a set of the first end plane 2203 and one flat plane 2205*a* of the pair of third planes; and (2) a set of the second end plane 2203 and one flat plane 2105*a* of the pair of second planes. Alternatively, only one of them may extend on the same plane. The shape is not limited to the shape in the embodiment.

Note that, in view of suppressing the deterioration in reflecting characteristics of the waveguide device 100 that is attributed to a discontinuous change in characteristic impedance, it is desirable to have internal wall planes which are overlapped in a state where each of the plane sets mentioned above are extending on the individual same flat plane, as shown in the drawings of the present embodiment.

In addition, in the present embodiment, the description has been given by dividing the waveguide device 100 into two parts (first and second waveguide parts 1101 and 1201) for the sake of expedience. However, the number of divisions and divide ranges are not limited to those in the above description. In addition, there is no need to make the waveguide device 100 dividable into the above-described parts in the mounting.

Figure 18:
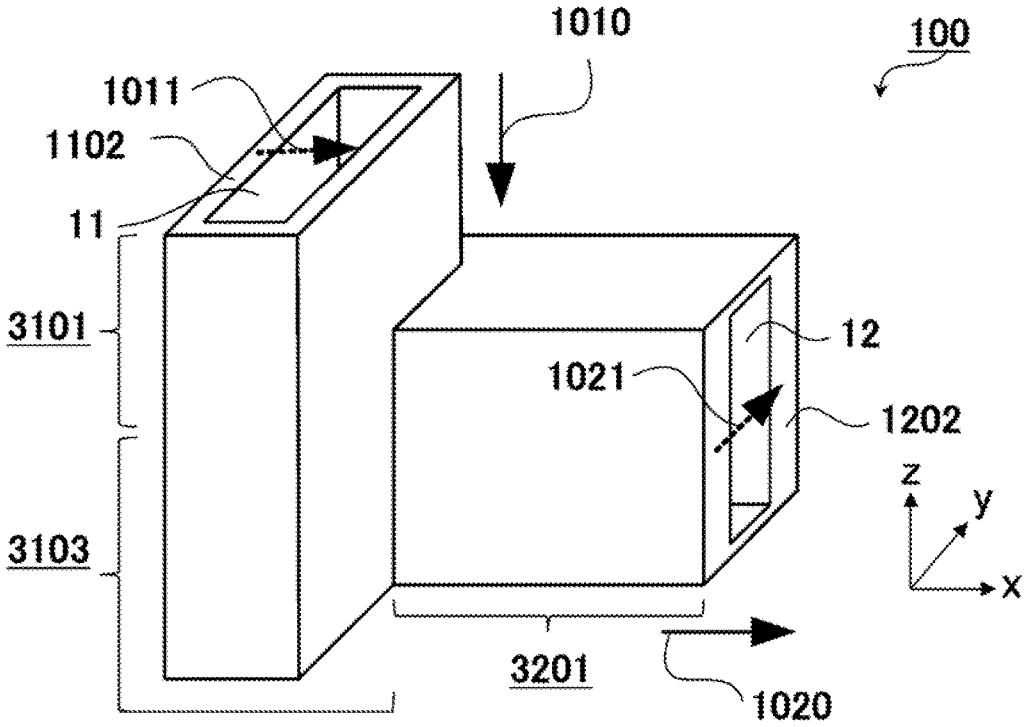
FIG. 18 is a diagram depicting a perspective view of an external appearance of the waveguide device according to the Embodiment 1 of the present invention.

FIG. 18 is a diagram depicting a perspective view of an external appearance of the waveguide device according to the Embodiment 1 of the present invention. The way of viewing of the drawing is similar to FIG. 1 described above.

The drawing expediently represents that the waveguide device 100 is divided into three parts.

In the drawing, 3101 denotes a first waveguide part, 3103 denotes a connection part, and 3201 denotes a second waveguide part. The names of these parts are not limited to the above-described names, and can be changed.

When the waveguide device 100 is considered with being divided into three parts, the structure of the waveguide device 100 can be considered to be obtained by uniting two waveguides corresponding to a waveguide corresponding to the first waveguide part, a waveguide corresponding to the second waveguide part, and the connection part 3103, in place of the two waveguides shown in FIG. 6.

In addition, in the present embodiment, in order to simplify the description of the invention, the description has been given of a case where the tube axis direction of the waveguide device 100 is changed orthogonally (i.e., changed from the z direction to the x direction in the drawings). Alternatively, the waveguide device 100 can be formed so that the tube axis direction is changed by an angle other than the right angle depending on the situation where the waveguide device 100 is applied.

In the present embodiment, the waveguide device 100 does not change an angle in the y-axis direction in the drawings. Alternatively, the waveguide device 100 may be formed so that an angle is changed in the y-axis direction. If the changed angle is not the right angle, the waveguide paths may be formed such that, the shape of the region 1305 is similar to the above-described shape, and in the waveguide structures other than the region 1305, the tube axis directions are not orthogonal to each other.

In the description of the present embodiment, in order to clarify the structure of the waveguide device 100, the description has been given supposing the two waveguides 2101 and 2201 for the sake of expedience. However, the waveguide device 100 need not be formed by actually uniting two members, and two members may be integrally formed.

In the present embodiment, the individual waveguide paths defied by the first internal wall 1101*a* and the second internal wall 1201*a* have the corresponding protruding faces 1104 and 1204. Alternatively, only one of the internal walls may have the corresponding protruding face, and the configuration is not limited to the embodiment.

In the present embodiment, the first and second opening parts 1102 and 1202 have structures in which only the respective openings 11 and 12 are formed. Alternatively, an opening part may be formed to include a structure for connecting the waveguide device 100 with a connection destination, such as (1) a screw hole or (2) a flange, for example. A broad-sense waveguide device 100 including elements other than the configurations indicated in the drawings can be defined.

In addition, in the present embodiment, the description has been given assuming that the first and second waveguide parts 1101 and 1201 are integrally formed. However, the configuration is not limited to the embodiment. For example, the waveguide device 100 may be formed to be dividable into a plurality of parts, and the plurality of parts may be assembled.

In this case, a structure for assembly such as, for example, (1) a screw hole or (2) a flange may be formed in each part. The each part is desirably dividable into a shape that can be subjected to metal molding processing.

In the present embodiment, the description has been given assuming that there are two connection destination devices, and each of the devices includes one opening part. However, the present invention is not limited to the case. For example, the present invention may be applied to a case where there is one connection destination device, and two opening parts included in the device are connected.

In the present embodiment, the description has been given of the case where each includes one waveguide part different in the tube axis direction and the polarization direction, namely, the case where there are two opening parts. However, this can be considered to be the description given while attention is paid to the two opening parts, and the structure and the number are not limited to those indicated in the drawings. For example, another one structure similar to one waveguide part may be formed on the opposite side in the −y direction in the drawing, so that the waveguide device 100 has a structure including three opening parts.

In this case, even in a case where the waveguide device 100 is considered to include a structure corresponding to a structure obtained by uniting a plurality of waveguides, in place of a protruding face of a bottom part of a recessed part of one waveguide, a device provided with a configuration similar to the other waveguide can be considered.

In the present embodiment, although the description has been given assuming the TE mode, the mode is not limited to the TE mode. For example, the waveguide device 100 can employ any of the following: (a) use in another mode; (b) use in combination with another mode; and (c) common use with another mode.

In the present embodiment, the description has been given of the case of changing each of the tube axis direction and the polarization direction orthogonally. However, the present invention is not limited to the above-described case, and (a) one of the directions may be changed non-orthogonally or (b) both of the directions may be changed by an angle other than the right angle.

In addition, a plurality of modifications among the above-described various modifications may be applied to the same device.

(Embodiment 2)

Embodiment 2 of the present invention will be described below with referring to FIG. 19.

Figure 19:
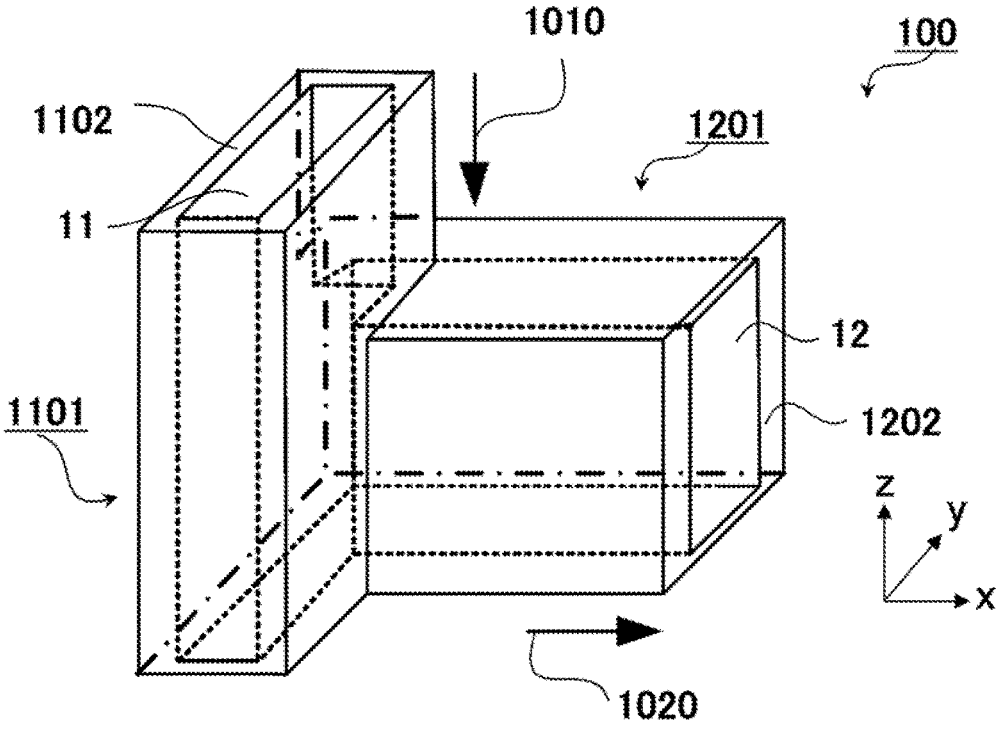
FIG. 19 is a diagram depicting a side view of a transparently-viewed structure of a waveguide device according to Embodiment 2 of the present invention.

FIG. 19 is a diagram depicting a side view of a transparently-viewed structure of a waveguide device according to the Embodiment 2 of the present invention. The way of viewing of the drawing is similar to FIG. 2 of the above-described Embodiment 1.

FIG. 19 differs from FIG. 2 of the above-described Embodiment 1 in that the first protruding face 1104 and the second protruding face 1204 are not formed.

In the case of the present embodiment, impedance adjustment described in the Embodiment 1 can be performed by selecting, as a parameter (or parameters), any of the cross-sectional shape, the dimension, the dimension ratio, and the like in each waveguide path.

As described above, according to the waveguide device of the present embodiment, a waveguide device similar to the above-described Embodiment 1 can be obtained.

In addition, the shape of the waveguide path is simplified as compared with the above-described Embodiment 1. Therefore, at least one of cost, time, and energy required for the processing of the waveguide device 100, or die processing of the waveguide device 100 can be suppressed.

Among various modifications for the above-described Embodiment 1, modifications other than the modification of the protruding face may be applied to the waveguide device 100 of the present embodiment to form a new waveguide device 100. More specifically, (1) the modification of the external form of the waveguide device 100, (2) a set of planes extending with an overlap region on the same flat plane, (3) a relative angle of the tube axis direction, (4) the structure and the number of opening parts, (5) whether integrally formed or dividable, (6) the existence or non-existence of a structure for connection or assembly, and (7) the applicability of an available electromagnetic wave mode may be different. In addition, a plurality of modifications among the above-described modifications may be applied.

Note that, various modifications can be applied to the present embodiment similarly to the above-described Embodiment 1. Thus, the description thereof is omitted.

(Embodiment 3)

Embodiment 3 of the present invention will be described below with referring to FIGS. 20 and 21.

Figure 20:
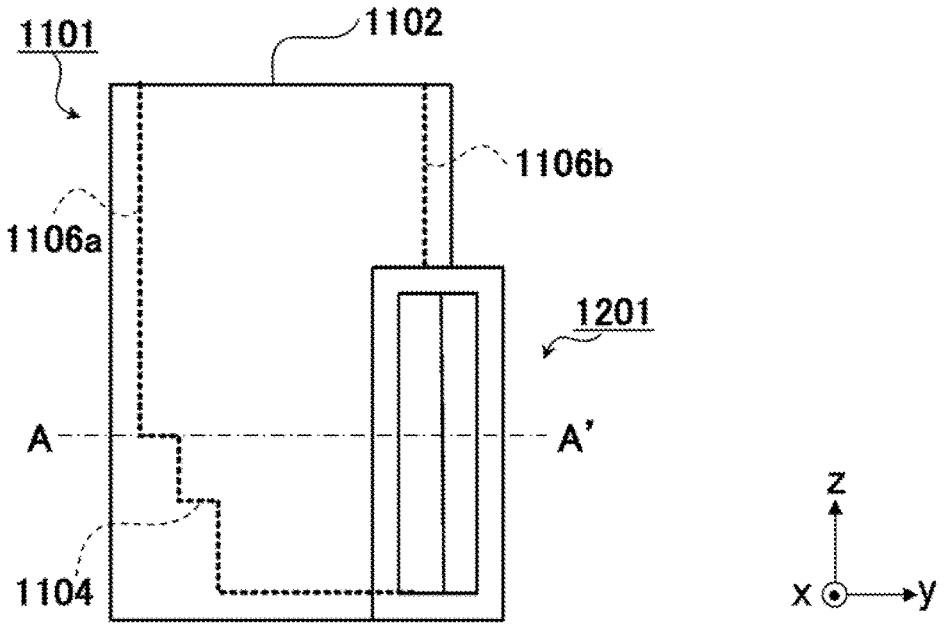
FIG. 20 is a diagram depicting a side view of a transparently-viewed structure of a waveguide device according to Embodiment 3 of the present invention.
Figure 21:
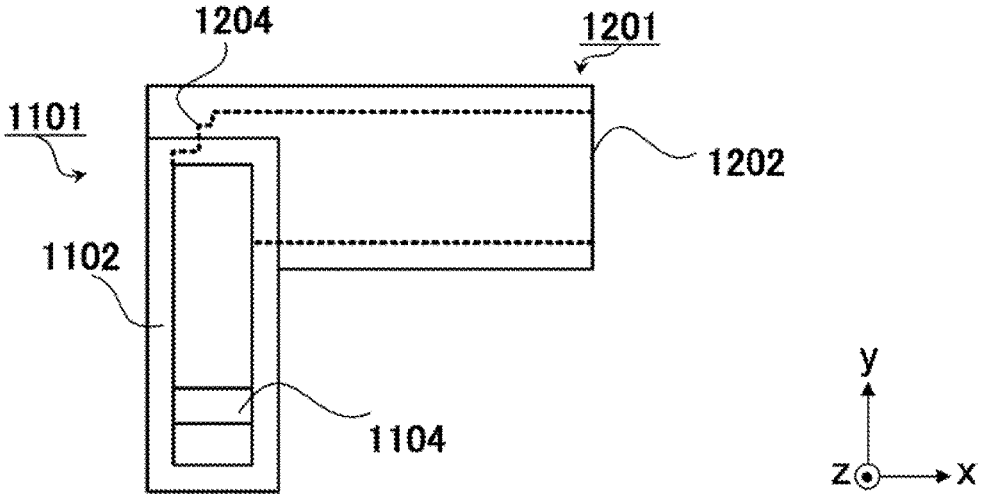
FIG. 21 is a diagram depicting a top view of a transparently-viewed structure of the waveguide device according to the Embodiment 3 of the present invention.

FIGS. 20 and 21 are a side view and a top view of a transparently-viewed structure of a waveguide device according to the Embodiment 3 of the present invention.

The way of viewing of the drawing is similar to FIGS. 4 and 5 of the above-described Embodiment 1. In addition, in the drawing, a line A-A' indicates a position of a cross section of the waveguide device 100.

The present embodiment differs from the above-described Embodiment 1 in that the first protruding face 1104 and the second protruding face 1204 are formed in step-like.

Also in the case where the two waveguides 2101 and 2201 described in the above-described Embodiment 1, it can be similarly considered that the protruding face 1204 is formed by step-like planes in each of them.

According to the waveguide device of the present embodiment, a waveguide device similar to the above-described Embodiment 1 can be obtained.

In addition, by providing the step-like protruding faces 1104 and 1204, an effect similar to the above-described Patent Literature 1 is achieved.

In the present embodiment, step-like protruding faces are formed in both of the first waveguide part 1101 and the second waveguide part 1201. Alternatively, a step-like protruding face may be formed in either one of the waveguide parts.

The waveguide device 100 may be formed to be dividable at the position of the line A-A' into two components.

The two components can be formed such that, for example, they have been subjected to cutting processing in such a manner that a plane parallel to an x-y plane at the line A-A' is manufactured to be a division plane. The waveguide device 100 can be formed by assembling the two components by matching a stair shape and the division plane. The manufacturing of this waveguide device 100 becomes easier as compared with the case of the above-described Embodiment 1 in which planar protruding faces are formed.

As for modifications other than the modification of protruding faces, various modifications in the above-described Embodiments 1 and 2 may be applied to the waveguide device of the present embodiment, and this may be regarded as a new waveguide device. Various modifications can be applied to the present embodiment similarly to the above-described Embodiments 1 and 2. Thus, the description thereof is omitted.

(Embodiment 4)

Embodiment 4 of the present invention will be described below with referring to FIGS. 22 and 23.

Figure 22:
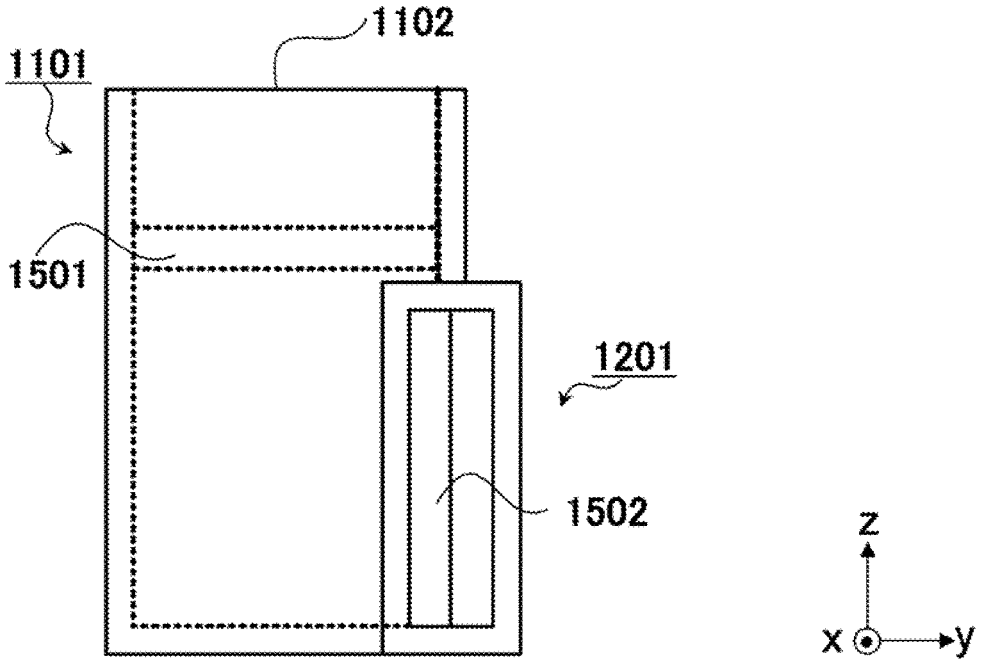
FIG. 22 is a diagram depicting a side view of a transparently-viewed structure of a waveguide device according to Embodiment 4 of the present invention.
Figure 23:
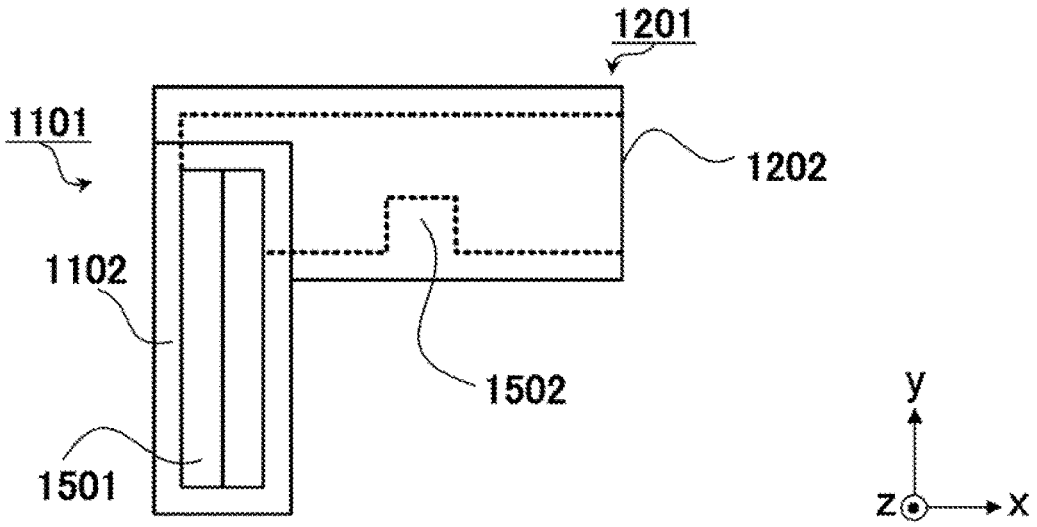
FIG. 23 is a diagram depicting a top view of a transparently-viewed structure of the waveguide device according to the Embodiment 4 of the present invention.

FIGS. 22 and 23 are a side view and a top view of a transparently-viewed structure of a waveguide device according to the Embodiment 4 of the present invention.

In the drawing, 1501 and 1502 denote so-called irises.

The present embodiment differs from the above-described Embodiment 2 in that each of the first waveguide part 1101 and the second waveguide part 1201 has an iris. Thus, the internal walls 200 are formed to have iris-like wall planes.

Also in the two waveguides 2101 and 2201 described in the above-described Embodiment 1, it can be similarly considered that an iris is formed in each of the waveguides.

Note that, in the present embodiment, a capacitive iris is formed.

The position where the iris is formed may change depending on a mounting form of the waveguide device. For example, an iris can be formed at a position distant from an overlap region of the waveguides 2101 and 2201 by about ½ wavelength.

According to the waveguide device of the present embodiment, a waveguide device similar to the above-described Embodiment 1 can be obtained.

In addition, impedance adjustment described in the above-described Embodiment 1 can also be performed by using the iris. Since parameters for impedance adjustment is increased, the design flexibility of the waveguide device 100 may be improved.

In the present embodiment, one capacitive iris is formed in each waveguide part. Alternatively, an inductive iris may be formed. In addition, the number of irises may be plural, and is not limited to the configuration indicated in the drawings.

Various modifications in the above-described Embodiments 1 to 3 may be applied to the waveguide device of the present embodiment, and this may be regarded as a new waveguide device. Various modifications can be applied to the present embodiment similarly to the above-described Embodiment 1. Thus, the description thereof is omitted.

11 a first opening
12 a second opening
100 a waveguide device
200 internal walls (or a waveguide path defined by internal walls)
1010 a first direction (or a first tube axis direction)
1011 a first polarization direction
1020 a second direction (or second tube axis direction)
1021 a second polarization direction
1101 a first waveguide part
1101*a* an internal wall on the first waveguide part side (or a waveguide path defined by the internal wall)
1102 a first opening part
1103 a first end plane
1104 a first protruding face
1105 (1105*a*, 1105*b*) a pair of second planes of the first waveguide part
1106 (1106*a*, 1106*b*) a pair of second planes
1201 a second waveguide part
1201*a* an internal wall on the second waveguide part side (or a waveguide path defined by the internal wall)
1202 a second opening part
1203 a second end plane
1204 a second protruding face
1205 (1205*a*, 1205*b*) a pair of third planes
1206 (1206*a*, 1206*b*) a pair of fourth planes
1300 waveguides
1301 a plane (or an overlap range)
1302 an imaginary plane
1303 impedance
1304 an imaginary plane
1305 a region between planes 1302 and 1304
1306 impedance
1401 a locus of impedance
1402 a chart center
1403 a center of locus of impedance
1404 and 1405 directions (or arrows indicating the directions)
1406 impedance
2101 a first waveguide
2101*a* an internal wall of the first waveguide
2103 a first end plane
2104 a first protruding face
2105 (2105*a*, 2105*b*) a pair of second planes
2106 (2106*a*, 2106*b*) a pair of first planes
2201 a second waveguide
2201*a* an internal wall of the second waveguide
2203 a second end plane
2204 a second protruding face
2205 (2205*a*, 2205*b*) a pair of third planes
2206 (2206*a*, 2206*b*) a pair of fourth planes
3101 a first waveguide part (or a first opening part)
3103 a connection part
3201 a second waveguide part (or a second opening part)
x, y, and z expedient coordinate axes

The invention claimed is:

1. A waveguide device (100) in which a first opening (11) and a second opening (12) are formed at end parts of a waveguide path, the waveguide device (100) comprising:

a waveguide path obtained by uniting a first waveguide (1101) and a second waveguide (1201), wherein the first waveguide (1101) is provided with a first recessed part (2101*b*) which has an opening with a same shape as the first opening (11) and also has a bottom part being formed in a first direction (1010) as seen from the opening of the first recessed part (2101*b*), the second waveguide (1201) is provided with a second recessed part (2201*b*) which has an opening with a same shape as the second opening (12) and also has a bottom part being formed in a second direction (1020) as seen from the opening of the second recessed part (2201*b*), and the first waveguide (1101) and the second waveguide (1201) are united in a manner such that, center positions of the first and second openings (11, 12) are different from each other in a direction being different from the first and second directions (1010, 1020), spatial regions of the bottom parts of the first and second recessed part (2101*b*, 2201*b*) partly overlap with each other in the different direction, a length of a region (1305) where the spatial regions of the bottom parts of the first and second recessed part (2101*b*, 2201*b*) partly overlap is equal to or less than ½of an in-tube wavelength of electromagnetic waves propagating in the waveguide path, and the first and second recessed parts (2101*b*, 2201*b*) connect with each other at the respective bottom parts.

2. The waveguide device (100) according to claim 1, further comprising an iris-like internal wall (1501; 1502) which is formed on at least one of the first and second recessed parts (2101*b*, 2201*b*).

3. The waveguide device (100) according to claim 1, further comprising a protruding face (1104; 1204) which is formed on at least one of the bottom parts of the first and second recessed parts (2101*b*, 2201*b*).

4. The waveguide device (100) according to claim 3, wherein the protruding face (1104; 1204) is formed in a step-like shape, and allows dividing the wavelength device (100) at a position of one plane closest to an opening part side of the step-like protruding face (1104; 1204).

5. The waveguide device (100) according to claim 1, wherein the first opening (11) has a first shape having a long side direction and a short side direction, the second opening (12) has a second shape having a long side direction and a short side direction, and the long side directions of the first and second shapes are different from each other.

6. The waveguide device (100) according to claim 5, wherein the first and second shapes are both rectangles, rounded-cornered squares, or ellipses.

7. The waveguide device (100) according to claim 5, wherein the first and second shapes are both rectangles or rounded-cornered squares, the first recessed part (2101*b*) is defined by a first internal wall (1101*a*) including: a pair of first planes (1106*a*, 1106*b*) which are separately formed in the long side direction of the first shape; a pair of second planes (1105*a*, 1105*b*) which are separately formed in the short side direction of the first shape; and a first end plane (1103) which is formed on the bottom part of the first recessed part, the second recessed part (2201*b*) is defined by a second internal wall (1201*a*) including: a pair of third planes (1205*a*, 1205*b*) which are disposed in the long side direction of the second shape; a pair of fourth planes (1206*a*, 1206*b*) which are disposed in the short side direction of the second shape; and a second end plane (1203) which is formed on the bottom part of the second recessed part (2201*b*), and a plane included in at least one of plane sets has an overlap range, said plane sets being a set of the first end plane (1103) of the first recessed part (2101*b*) and one of the pair of third planes (1205*a*, 1205*b*) of the second recessed part (2201*b*), and a set of one of the pair of second planes (1105*a*, 1105*b*) of the first recessed part (2101*b*) and the second end plane (1203) of the second recessed part (2201*b*).

* * * * *